US006928385B2

(12) United States Patent
Ebisawa

(10) Patent No.: US 6,928,385 B2
(45) Date of Patent: Aug. 9, 2005

(54) METHOD OF SELECTING MATCHING TYPE OF SIZE OF HELMET, AND METHOD OF ADJUSTING SIZE OF HELMET BY USING SUCH SELECTING METHOD

(75) Inventor: Takashi Ebisawa, Toyko (JP)

(73) Assignee: Shoei, Co., Ltd., Tokyo (JP)

( * ) Notice: Subject to any disclaimer, the term of this patent is extended or adjusted under 35 U.S.C. 154(b) by 0 days.

(21) Appl. No.: 10/781,066

(22) Filed: Feb. 18, 2004

(65) Prior Publication Data

US 2004/0204904 A1 Oct. 14, 2004

(30) Foreign Application Priority Data

Mar. 28, 2003 (JP) ..... 2003-091490

(51) Int. Cl.[7] ..... G06F 15/00
(52) U.S. Cl. ..... 702/155
(58) Field of Search ..... 702/155, 170; 2/410, 6.3, 421, 9, 413, 420; 600/371, 414; 29/602; 33/533; 34/60; 119/61

(56) References Cited

U.S. PATENT DOCUMENTS 4,896,962 A * 1/1990 Menn et al. ..... 356/139.03
6,351,265 B1 * 2/2002 Bulman ..... 345/660
6,442,765 B1 * 9/2002 Fallon et al. ..... 2/410

* cited by examiner

*Primary Examiner*—Michael Nghiem
*Assistant Examiner*—Tung S. Lau
(74) *Attorney, Agent, or Firm*—Jones Day

(57) ABSTRACT

The back-and-forth length and right-to-left width of the head of a helmet wearer are input to a computer and data-processed, so that the type of a helmet size that matches the helmet wearer and its matching data are selected and displayed on a computer window or the like. A helmet of a size that matches the helmet wearer can be obtained easily together with its matching data. Even when a helmet wearer having a head shape different from an average human head shape is to wear a helmet, the helmet can be matched to the head of the helmet wearer substantially optimally by only performing comparatively simple size adjusting operation in accordance with the matching data.

28 Claims, 12 Drawing Sheets

FIG.2A
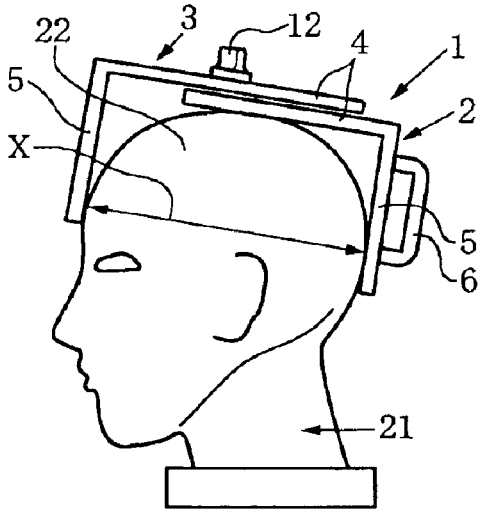
FIG.2B
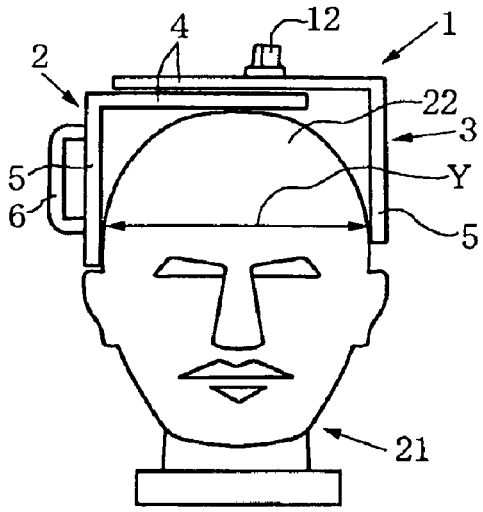
FIG.2C
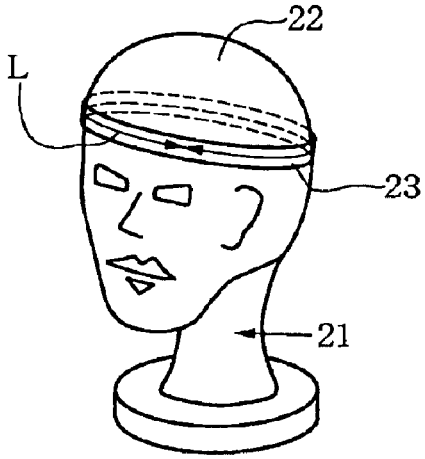
FIG.3
42
52
51
| L SIZE (cm) | 53~54 | 55~56 | 57~58 | 59~60 | 61~62 | 63~64 |
|---|---|---|---|---|---|---|
| MATCHING SIZE | XS | S | M | L | XL | XXL |

FIG.5

53

55

54

| X SIZE / Y SIZE | 148 | 149 | 150 | 151 | 152 | 153 |
|---|---|---|---|---|---|---|
| 181 | F & R: TIGHT<br>L & R: OPN L | F & R: TIGHT<br>L & R: OPN M | F & R: TIGHT<br>L & R: OPN M | F & R: TIGHT<br>L & R: LOOSE | F & R: TIGHT<br>L & R: JUST | F & R: TIGHT<br>L & R: TIGHT |
| 180 | F & R: JUST<br>L & R: OPN L | F & R: JUST<br>L & R: OPN M | F & R: JUST<br>L & R: OPN M | F & R: JUST<br>L & R: LOOSE | F & R: JUST<br>L & R: JUST | F & R: JUST<br>L & R: TIGHT |
| 179 | F & R: LOOSE<br>L & R: OPN L | F & R: LOOSE<br>L & R: OPN M | F & R: LOOSE<br>L & R: OPN M | F & R: LOOSE<br>L & R: LOOSE | F & R: LOOSE<br>L & R: JUST | F & R: LOOSE<br>L & R: TIGHT |
| 178 | F & R: OPN C<br>L & R: OPN L | F & R: OPN C<br>L & R: OPN M | F & R: OPN C<br>L & R: OPN M | F & R: OPN C<br>L & R: LOOSE | F & R: OPN C<br>L & R: JUST | F & R: OPN C<br>L & R: TIGHT |
| 177 | F & R: OPN C<br>L & R: OPN L | F & R: OPN C<br>L & R: OPN M | F & R: OPN C<br>L & R: OPN M | F & R: OPN C<br>L & R: LOOSE | F & R: OPN C<br>L & R: JUST | F & R: OPN C<br>L & R: TIGHT |
| 176 | F & R: OPN B<br>L & R: OPN L | F & R: OPN B<br>L & R: OPN M | F & R: OPN B<br>L & R: OPN M | F & R: OPN B<br>L & R: LOOSE | F & R: OPN B<br>L & R: JUST | F & R: OPN B<br>L & R: TIGHT |

FIG.7A

| | | | | | | |
|---|---|---|---|---|---|---|
| 187 | F & R: TIGHT<br>L & R: OPN K | F & R: TIGHT<br>L & R: OPN N | F & R: TIGHT<br>L & R: OPN N | F & R: TIGHT<br>L & R: OPN M | F & R: TIGHT<br>L & R: OPN M | F & R: TIGHT<br>L & R: OPN M |
| 186 | F & R: JUST<br>L & R: OPN K | F & R: JUST<br>L & R: OPN N | F & R: JUST<br>L & R: OPN N | F & R: JUST<br>L & R: OPN M | F & R: JUST<br>L & R: OPN M | F & R: JUST<br>L & R: OPN M |
| 185 | F & R: LOOSE<br>L & R: OPN K | F & R: LOOSE<br>L & R: OPN N | F & R: LOOSE<br>L & R: OPN N | F & R: LOOSE<br>L & R: OPN M | F & R: LOOSE<br>L & R: OPN M | F & R: LOOSE<br>L & R: OPN M |
| 184 | F & R: OPN C<br>L & R: OPN K | F & R: OPN C<br>L & R: OPN N | F & R: OPN C<br>L & R: OPN N | F & R: OPN C<br>L & R: OPN M | F & R: OPN C<br>L & R: OPN M | F & R: OPN C<br>L & R: OPN M |
| 183 | F & R: OPN C<br>L & R: OPN K | F & R: OPN C<br>L & R: OPN N | F & R: OPN C<br>L & R: OPN N | F & R: OPN C<br>L & R: OPN M | F & R: OPN C<br>L & R: OPN M | F & R: OPN C<br>L & R: OPN M |
| 182 | F & R: OPN B<br>L & R: OPN K | F & R: OPN B<br>L & R: OPN N | F & R: OPN B<br>L & R: OPN N | F & R: OPN B<br>L & R: OPN M | F & R: OPN B<br>L & R: OPN M | F & R: OPN B<br>L & R: OPN M |
| X SIZE / Y SIZE | 148 | 149 | 150 | 151 | 152 | 153 |

FIG.7B

| | | | | | | |
|---|---|---|---|---|---|---|
| 181 | F & R: OPN B<br>L & R: OPN L | F & R: OPN B<br>L & R: OPN M | F & R: OPN B<br>L & R: OPN M | F & R: OPN B<br>L & R: LOOSE | F & R: OPN B<br>L & R: JUST | F & R: OPN B<br>L & R: TIGHT |
| 180 | F & R: OPN A<br>L & R: OPN L | F & R: OPN A<br>L & R: OPN M | F & R: OPN A<br>L & R: OPN M | F & R: OPN A<br>L & R: LOOSE | F & R: OPN A<br>L & R: JUST | F & R: OPN A<br>L & R: TIGHT |
| 179 | F & R: OPN A<br>L & R: OPN L | F & R: OPN A<br>L & R: OPN M | F & R: OPN A<br>L & R: OPN M | F & R: OPN A<br>L & R: LOOSE | F & R: OPN A<br>L & R: JUST | F & R: OPN A<br>L & R: TIGHT |
| 178 | F & R: OPN D<br>L & R: OPN L | F & R: OPN D<br>L & R: OPN M | F & R: OPN D<br>L & R: OPN M | F & R: OPN D<br>L & R: LOOSE | F & R: OPN D<br>L & R: JUST | F & R: OPN D<br>L & R: TIGHT |
| 177 | F & R: OPN D<br>L & R: OPN L | F & R: OPN D<br>L & R: OPN M | F & R: OPN D<br>L & R: OPN M | F & R: OPN D<br>L & R: LOOSE | F & R: OPN D<br>L & R: JUST | F & R: OPN D<br>L & R: TIGHT |
| 176 | F & R: OPN E<br>L & R: OPN L | F & R: OPN E<br>L & R: OPN M | F & R: OPN E<br>L & R: OPN M | F & R: OPN E<br>L & R: LOOSE | F & R: OPN E<br>L & R: JUST | F & R: OPN E<br>L & R: TIGHT |
| X SIZE / Y SIZE | 154 | 155 | 156 | 157 | 158 | 159 |

FIG.7C

56

| X SIZE / Y SIZE | 154 | 155 | 156 | 157 | 158 | 159 |
|---|---|---|---|---|---|---|
| 187 | F & R: TIGHT<br>L & R: OPN L | F & R: TIGHT<br>L & R: OPN M | F & R: TIGHT<br>L & R: OPN M | F & R: TIGHT<br>L & R: LOOSE | F & R: TIGHT<br>L & R: JUST | F & R: TIGHT<br>L & R: TIGHT |
| 186 | F & R: JUST<br>L & R: OPN L | F & R: JUST<br>L & R: OPN M | F & R: JUST<br>L & R: OPN M | F & R: JUST<br>L & R: LOOSE | F & R: JUST<br>L & R: JUST | F & R: JUST<br>L & R: TIGHT |
| 185 | F & R: LOOSE<br>L & R: OPN L | F & R: LOOSE<br>L & R: OPN M | F & R: LOOSE<br>L & R: OPN M | F & R: LOOSE<br>L & R: LOOSE | F & R: LOOSE<br>L & R: JUST | F & R: LOOSE<br>L & R: TIGHT |
| 184 | F & R: OPN C<br>L & R: OPN L | F & R: OPN C<br>L & R: OPN M | F & R: OPN C<br>L & R: OPN M | F & R: OPN C<br>L & R: LOOSE | F & R: OPN C<br>L & R: JUST | F & R: OPN C<br>L & R: TIGHT |
| 183 | F & R: OPN C<br>L & R: OPN L | F & R: OPN C<br>L & R: OPN M | F & R: OPN C<br>L & R: OPN M | F & R: OPN C<br>L & R: LOOSE | F & R: OPN C<br>L & R: JUST | F & R: OPN C<br>L & R: TIGHT |
| 182 | F & R: OPN B<br>L & R: OPN L | F & R: OPN B<br>L & R: OPN M | F & R: OPN B<br>L & R: OPN M | F & R: OPN B<br>L & R: LOOSE | F & R: OPN B<br>L & R: JUST | F & R: OPN B<br>L & R: TIGHT |

METHOD OF SELECTING MATCHING TYPE OF SIZE OF HELMET, AND METHOD OF ADJUSTING SIZE OF HELMET BY USING SUCH SELECTING METHOD

TECHNICAL FIELD

The present invention relates to a method of selecting a matching type of the size of a helmet such as a full-face-type helmet, and a method of adjusting the helmet size of the matching type by using such selecting method.

BACKGROUND OF THE INVENTION

As the helmet size, generally, four sizes, i.e., S size (55 cm to 56 cm), M size (57 cm to 58 cm), L size (59 cm to 60 cm), and XL size (61 cm and more) are known. These values indicate the circumferential lengths of the heads of the helmet wearers. In the helmets of the four sizes, those portions of their head accommodating spaces which correspond to the head circumferential lengths have substantially elliptic shapes substantially similar to each other.

In helmet shops where helmets are sold, when selling a helmet to an expected helmet purchaser such as an expected helmet wearer who plans to wear a helmet, a helmet of the size informed by the expected helmet purchaser is sold to him or her. Alternatively, the circumferential length of the head of the expected helmet wearer is actually measured with a tape measure or the like. The type of the matching size is selected from the matching size displayed on the tape measure that corresponds to the actual measurement value, and a helmet of the selected type is sold.

Employment of a personal computer which uses software (i.e., a computer program) for arithmetic calculation of an elliptic shape at a helmet shop or the like has conventionally been known. In this case, the back-and-forth length and right-to-left width of the head of the expected helmet wearer are actually measured with a head size measuring tool, a measure or any other measurement tool. The circumferential length of the head is calculated from the actual measurement values by using the personal computer. The type of a recommendable helmet size is selected from the calculation value and the size marks attached to helmets of various sizes.

The conventional method as described above has the following drawbacks. More specifically, when the circumferential length of the head is to be actually measured with a tape measurement as described above, or when the circumferential length of the head is to be calculated by using a program for arithmetic calculation of an elliptic shape, it is assumed that the head of the expected helmet wearer has a specific elliptic shape substantially similar to an average elliptic shape of a human head. Hence, the ratio of the major axis to the minor axis of the specific elliptic shape is substantially constant regardless of the type of the helmet size.

The shapes of the circumferences of the heads of expected helmet wearers differ from one wearer to another even if the circumferential lengths are equal, and do not always coincide with the specific elliptic shape described above. For this reason, if the type of the helmet size is selected based on only the circumferential length of the head of the expected helmet wearer, sometimes the helmet of the size of the selected type does not fit (that is, match) the head of the expected helmet wearer. In this case, the expected helmet wearer must wear a helmet of an excessively large size.

SUMMARY OF THE INVENTION

It is, therefore, the primary object of the present invention to provide a method of selecting a type of a helmet size with which a helmet of a size type that matches the helmet wearer can be obtained easily together with matching data.

It is another object of the present invention to provide a method of adjusting a helmet size with which even when a helmet wearer having a head with a shape other than an average human head shape is to wear a helmet, the helmet can be matched to the head of the helmet wearer substantially optimally by only performing comparatively simple size adjustment operation in accordance with the matching data.

According to the first aspect of the present invention, there is provided a method of selecting a matching type of a size of a helmet, comprising the steps of inputting a back-and-forth length and right-to-left width of a head of a helmet wearer as data to a computer that can use a program necessary for selection of the type, processing the data of the back-and-forth length and right-to-left width by using the program, thus selecting the type of a helmet size, that matches the helmet wearer, and matching data of the type, and displaying the type of the matching helmet size and the matching data of the type.

According to the first aspect of the present invention, the matching data preferably includes information on whether or not size adjusting operation is necessary for the helmet of the type of the matching helmet size. According to the first aspect of the present invention, the method preferably further comprises the steps of inputting a circumferential length of the head of the helmet wearer as data to the computer, and processing the data of the circumferential length by using the program, thus selecting the type of a helmet size that matches the helmet wearer, wherein if the type of the helmet size selected based on the back-and-forth length and right-to-left width is smaller than the type of the helmet size selected based on the circumferential length, the type of the matching helmet size and matching data thereof may not be displayed. According to the first aspect of the present invention, the method preferably further comprises the step of displaying a fittingness of the type of the matching helmet size. According to the first aspect of the present invention, a type of a helmet size corresponding to a size region that includes an intersection of the back-and-forth length and right-to-left width on an adjusting data table included in the program, and matching data corresponding to a cell of the intersection on the adjusting data table are preferably selected.

According to the first aspect of the present invention, the matching data preferably includes matching data in a back-and-forth direction of a head accommodating space of the helmet, and matching data in a right-to-left direction of the head accommodating space. According to the first aspect of the present invention, a type of a helmet size corresponding to the circumferential length on a matching size table included in the program is preferably selected as the type of the helmet size that is selected based on the circumferential length. According to the first aspect of the present invention, the method preferably further comprises the step of actually measuring the back-and-forth length and right-to-left width of the head of the helmet wearer with a head size measuring tool, wherein the head size measuring tool comprises a pair of measuring tool pieces which are movable relative to each other and have substantial inverted-L shapes to form a substantial inverted-U shape as a whole, and a scale which indicates moved distances of the pair of measuring tool pieces relative to each other. According to the first aspect of the present invention, the method preferably comprises the step of actually measuring the circumferential length of the head of the helmet wearer with a tape measure.

According to the second aspect of the present invention, there is provided a method of adjusting a size of a helmet by using a selecting method according to the first aspect, wherein size adjusting operation of adjusting a size of a helmet which is of a type of the matching helmet size is performed based on an instruction on a necessity of the size adjusting operation included in the matching data. Also, according to the second aspect of the present invention, the size adjusting operation preferably comprises attaching at least one attaching pad to at least one portion of front, rear, left and right sides of the helmet such that the head accommodating space of the helmet decreases.

The above, and other, objects, features and advantages of this invention will become readily apparent from the following detailed description thereof which is to be read in connection with the accompanying drawings.

BRIEF DESCRIPTION OF THE DRAWINGS

FIG. 2A is a schematic side view showing a process of actually measuring a back-and-forth length X of the head of a helmet wearer by using the head size measuring tool of FIG. 1;

FIG. 2B is a schematic front view showing a process of actually measuring a right-to-left width Y of the head of the helmet wearer by using the head size measuring tool of FIG. 1;

FIG. 2C is a schematic perspective view showing a process of actually measuring a circumferential length L of the head of the helmet wearer by using a tape measure;

FIG. 3 is a matching size table which explains a process of selecting the matching type of the size of the helmet based on the circumferential length L actually measured in the process of FIG. 2C;

FIG. 5 is a detailed table of the XS region of the adjusting data table of FIG. 4;

FIG. 7A is a detailed table of the $S_1$ region of the adjusting data table of FIG. 6;

FIG. 7B is a detailed table of the $S_2$ region of the adjusting data table of FIG. 6;

FIG. 7C is a detailed table of the $S_3$ region of the adjusting data table of FIG. 6;

DETAILED DESCRIPTION OF THE INVENTION

An embodiment in which the present invention is applied to a method of selecting a matching type of the size of a full-face-type helmet and adjusting the size of the helmet of the selected-type size when necessary will be divided into items of "(1) arrangement of head size measuring tool", "(2) measurement of back-and-forth length, right-to-left width and circumferential length", "(3) selection of type of helmet size based on circumferential length", "(4) selection of type of helmet size based on back-and-forth length and right-to-left width and display of matching degree" and "(5) adjusting operation of helmet size", and the respective items will be sequentially described with reference to FIGS. 1 to 10E.

(1) Arrangement of Head Size Measuring Tool

Figure 1:
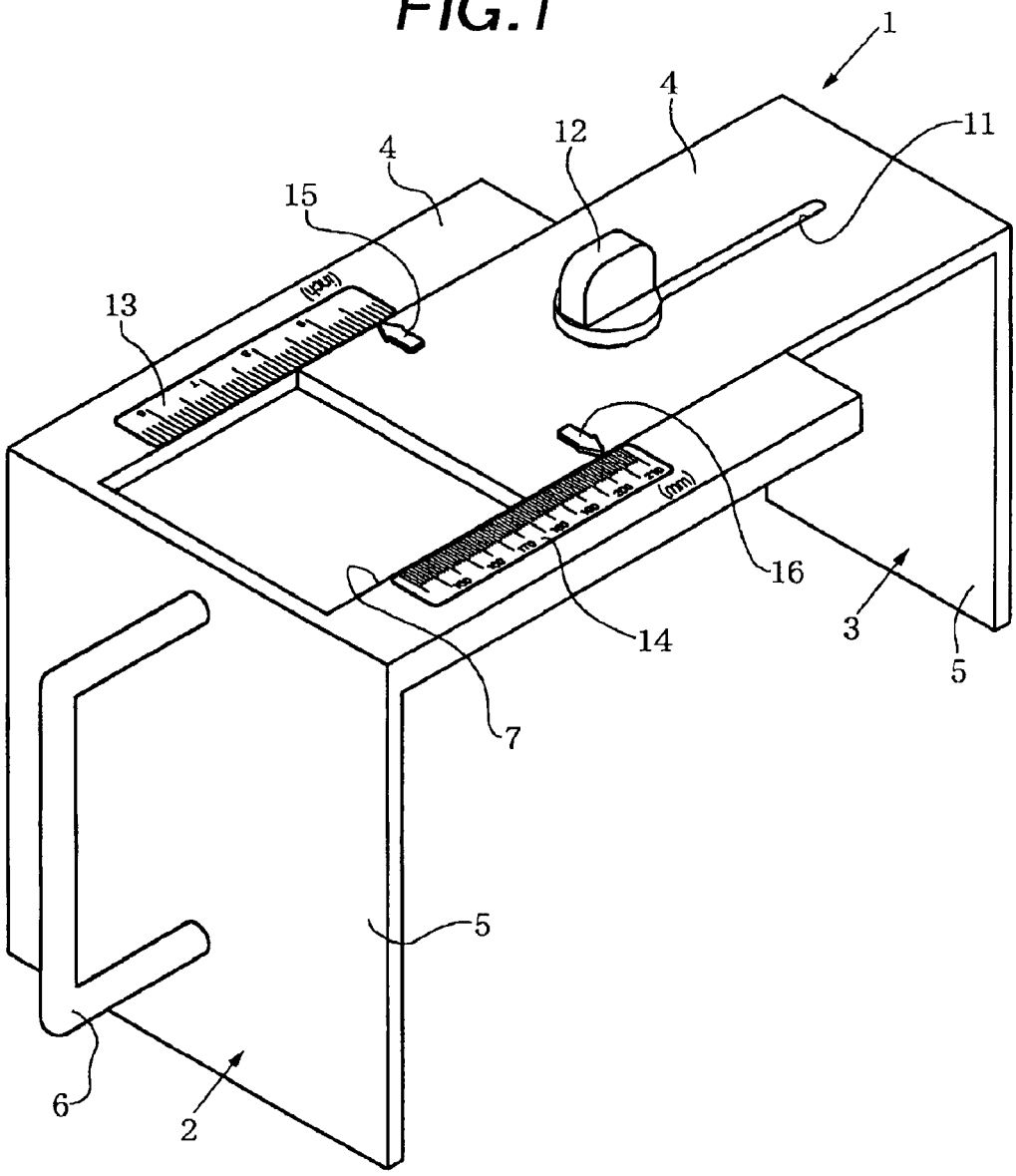
FIG. 1 is a perspective view of a head size measuring tool used in an embodiment in which the present invention is applied to a method of selecting a matching type of the size of a full-face-type helmet and adjusting the size of the helmet of the selected-type size when necessary.

As shown in FIG. 1, a head size measuring tool 1 has a pair of movable (e.g., slidable) measuring tool pieces 2 and 3, and forms a substantial inverted-U shape as a whole. Each of the measuring tool pieces 2 and 3 may be form a substantial inverted-L shape constituted by an upper plate 4 and side plate 5 integrally connected to each other. A handle 6 may be provided to the outer side surface of the side plate 5 of one measuring tool piece 2, of the pair of measuring tool pieces 2 and 3, to project sideways in a substantial lateral-U shape, substantial inverted-L shape or the like.

A guide recess 7 is formed in the upper surface of the upper plate 4 of one measuring tool piece 2, of the pair of measuring tool piece 2 and 3, to extend substantially in a direction substantially perpendicular to the planar directions of the side plates 5 of the measuring tool pieces 2 and 3. The upper plate 4 of the other measuring tool piece 3 slidably fits in the guide recess 7. Hence, the upper plate 4 of the other measuring tool piece 3, of the pair of measuring tool pieces 2 and 3, can slide relative to the upper plate 4 of one measuring tool piece 2 substantially along the guide recess 7.

A slit 11 is formed in the upper plate 4 of the other measuring tool piece 3, of the pair of measuring tool pieces 2 and 3, to extend substantially parallel to the guide recess 7. A bolt (not shown) is attached and fixed to the upper plate 4 of one measuring tool piece 2, such that its distal end portion extends upward through the slit 11 and projects upward from the slit 11. The distal end portion of the bolt is screwed into the nut (not shown) of an operation knob 12. Therefore, when the operation knob 12 is screwed and pivoted in the first direction so that the distal end portion of the bolt is screwed into the nut of the operation knob 12, the pair of measuring tool pieces 2 and 3 can be set in a fixed state where they cannot slide. When the operation knob 12 is screwed back and pivoted in the second direction opposite to the first direction, the pair of measuring tool pieces 2 and 3 can be set in a movable state where they can slide. Converse to this case, a screw shaft corresponding to the bolt may be provided to the operation knob 12, and a nut into which the screw shaft is to be screwed may be arranged on the upper plate 4 of one measuring tool piece 2.

Two different length scales 13 and 14 are arranged on the two sides of the guide recess 7 in the upper surface of the upper plate 4 of one measuring tool piece 2, of the pair of measuring tool pieces 2 and 3, to measure the distances between the inner side surfaces of the side plates 5 of the pair of measuring tool pieces 2 and 3. Pointers 15 and 16 are arranged on the upper surface of the upper plate 4 of the other measuring tool piece 3, to indicate predetermined values of the two different length scales 13 and 14, respectively, in accordance with the positions of the pair of measuring tool pieces 2 and 3 relative to each other. One of the two different length scales 13 and 14 may be of a length unit of the foot-pound-second system (more specifically, inch scale) 13, and the other one may be of a length unit 14 of the International System of Units (in other words, the metric system) (more specifically, centimeter or millimeter). Only either one of the two different length scales 13 and 14 may be provided to the head size measuring tool 1 depending on the country where the head size measuring tool 1 shown in FIG. 1 is used, or one or a plurality of types of scales of a length unit other than the foot-pound-second system and metric system may be provided to the head size measuring tool 1.

(2) Measurement of Back-and-Forth Length, Right-to-Left Width and Circumferential Length A process of actually measuring a back-and-forth length X and right-to-left width Y of a head 22 of a helmet wearer 21 by using the head size measuring tool 1 shown in FIG. 1, and a process of actually measuring a circumferential length L of the head 22 by using a string-like body 23 such as a tape measure will be described with reference to FIGS. 1 and 2. In the specification, a "helmet wearer" includes one who may wear a helmet 24 at least in the future, such as one who wishes to purchase and use a helmet 24 (see FIG. 10E).

The actual measuring process of the back-and-forth length X shown in FIG. 2A will be described. The operation knob 12 of the head size measuring tool 1 is screwed back and pivoted in the second direction, as described above, and the distance between the pair of side plates 5 of the pair of measuring tool pieces 2 and 3 is increased to be slightly larger than the back-and-forth length of the head 22. Subsequently, the head size measuring tool 1 is set on the head 22 such that the distance between the pair of side plates 5 corresponds to the longest portion, from the front part to the back part, of the head 22 (that is, as shown in FIG. 2A).

In this case, the measuring person (the measuring person can be the helmet wearer 21 himself) holds the handle 6 with one hand to fix one measuring tool piece 2 in position with respect to the head 22, and pushes the side plate 5 of the other measuring tool piece 3 with the other hand from its outer surface toward the side plate 5 of one measuring tool piece 2. The other measuring tool piece 3 slides to come close to one measuring tool piece 2. Thus, the upper plate 4 and side plate 5 of one measuring tool piece 2 abut against the top part (that is, the vertex part) and back part (that is, the occiput part) of the head 22, and the side plate 5 of the other measuring tool piece 3 abuts against the front part (that is, the sinciput part) of the head 22. The positions of one and the other measuring tool pieces 2 and 3 with respect to the head 22 may be reversed front side back.

When the measuring person screws and pivots the operation knob 12 in the first direction as describe above, the pair of measuring tool pieces 2 and 3 are set in a stationary state where they cannot slide. Accordingly, with the head size measuring tool 1 being attached to the head 22, or after it is removed from the head 22, the value on the length scale 13 or 14 pointed by the pointer 15 or 16 may be read as the actual measurement value of the back-and-forth length X of the head 22. In the following description, a case will be described wherein the length scale 14 of the metric system is to be read.

The actual measuring process of the right-to-left width Y shown in FIG. 2B will be described. The actual measuring process of the right-to-left width Y may be substantially equal to the actual measuring process of the back-and-forth length X shown in FIG. 2A, except that the target of actual measurement is changed from "the longest portion, from the front part to the back part, of the head 22" to "the largest portion, from the left part (that is, the left temble part) to the right part (that is, the right temble part), of the head 22".

The actual measuring process of the circumferential length L of the head 22 shown in FIG. 2C will be described. The string-like body 23 such as a tape measure is wound around that portion of the head 22 where the back-and-forth length is the largest and the right-to-left width is the largest. In the case of a tape measure 23, the length scale of the tape measure 23 is read. In the case of a mere string-like body having no length scale, the length of the string-like body which is wound on the head 22 one round is measured with a measure (not shown) or the like. Then, the actual measurement value of the circumferential length L can be obtained.

(3) Selection of Type of Helmet Size Based on Circumferential Length

Figure 9:
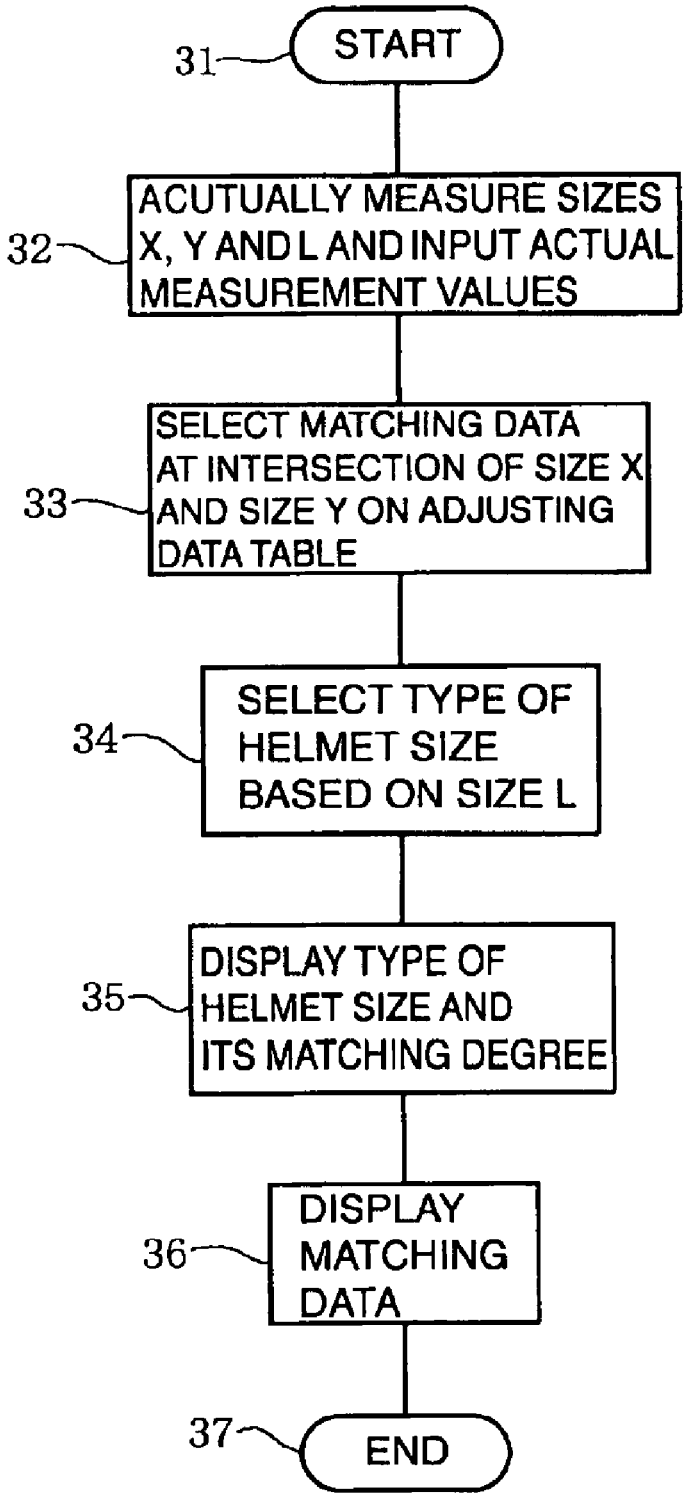
FIG. 9 is a flow chart of a process of selecting the matching type of the size of the helmet in accordance with FIGS. 1 to 7C and instructing whether or not size adjusting operation is necessary for the helmet of the selected-type size.

The back-and-forth length X, right-to-left width Y and circumferential length L actually measured in the above item (2) can be sequentially input to a computer (not shown) such as a personal computer every time each size is actually measured, or can be input to the personal computer at once after actual measurement of the three sizes is ended (see steps 31 and 32 of FIG. 9). The personal computer may have a preinstalled program necessary for sequentially performing the steps shown in FIG. 9, or can use the program via a computer network such as the Internet. The helmet shop may be equipped with such a personal computer, or the helmet wearer 21 may own such a personal computer.

Figure 10A:
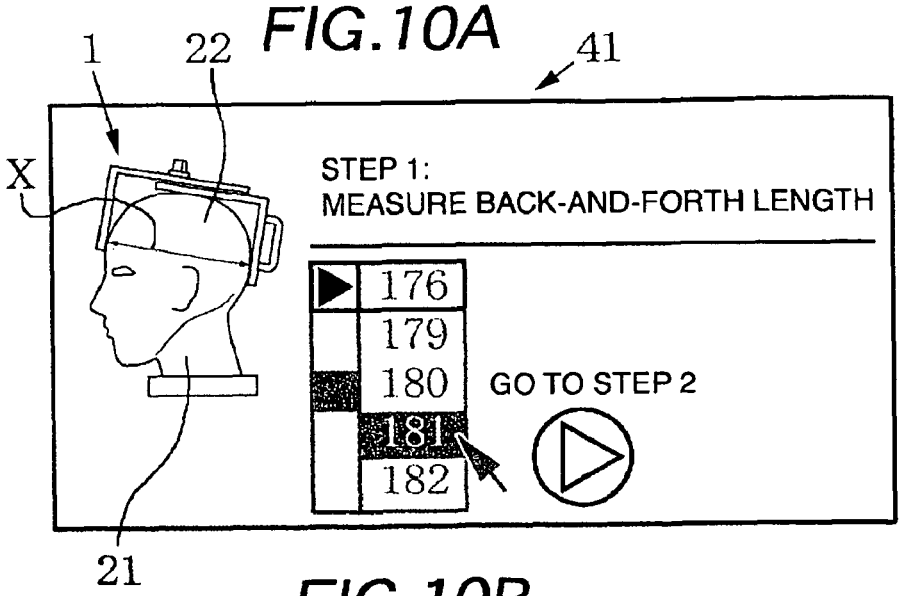
FIG. 10A is a view showing a personal computer window that displays a process of inputting the back-and-forth length X to the personal computer.
Figure 10B:
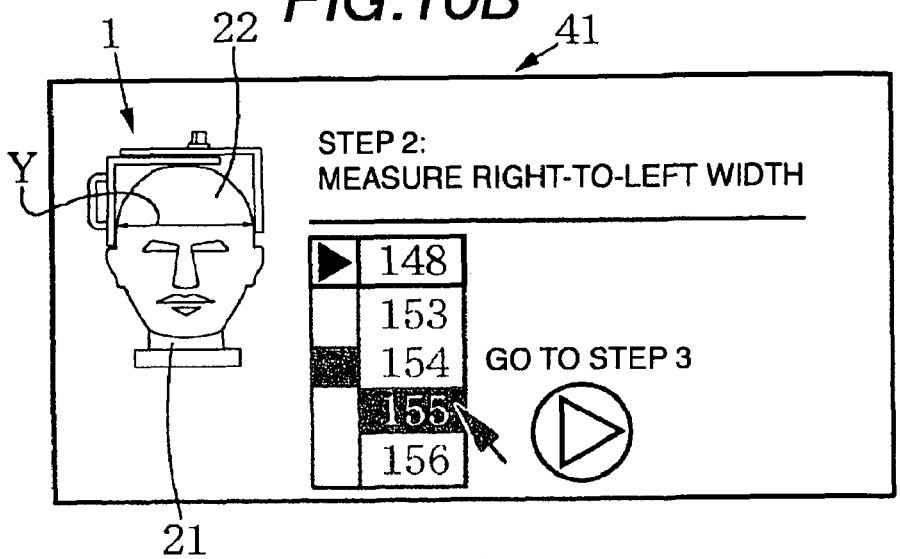
FIG. 10B is a view showing a personal computer window that displays a process of inputting the right-to-left width Y to the personal computer.
Figure 10C:
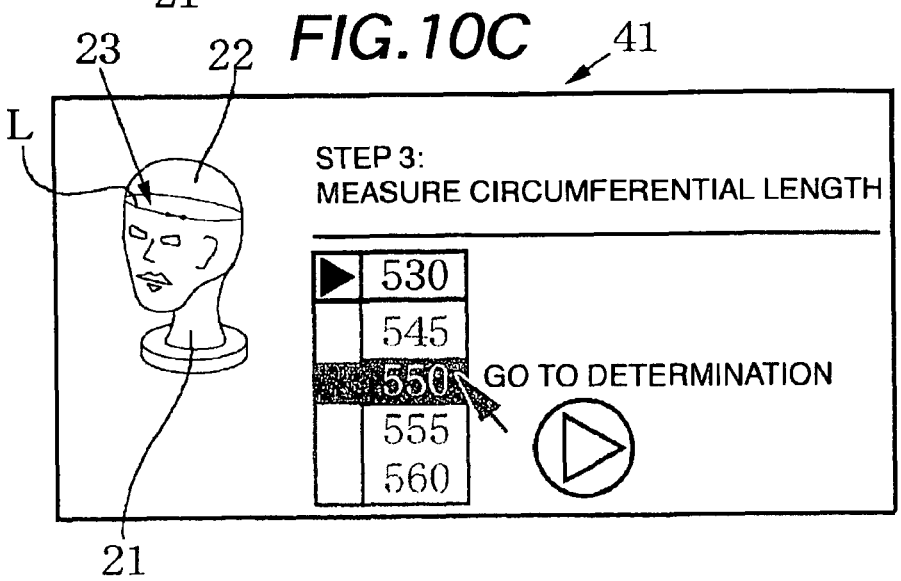
FIG. 10C is a view showing a personal computer window that displays a process of inputting the circumferential length L to the personal computer.

A window 41 on the personal computer when executing the above program is shown in FIGS. 10A to 10E which show personal computer windows 41 sequentially displaying the steps of FIG. 9. When executing the above program, in step 1, the window 41 of FIG. 10A is shown to the personal computer operator (e.g., an employee of the helmet shop, or the helmet wearer 21). In step 1, the personal computer operator inputs the actual measurement value (e.g., 181 mm) of the back-and-forth length X of the head 22 of the helmet wearer 21 to the persona computer. The personal computer operator advances the personal computer window 41 to step 2 shown in FIG. 10B, and inputs the actual measurement value (e.g., 155 mm) of the right-to-left width Y of the head 22 of the helmet wearer 21 to the personal computer. The personal computer operator then advances the personal computer window 41 to step 3 shown in FIG. 10C, and inputs the actual measurement value (e.g., 550 mm) of the circumferential length L of the head 22 of the helmet wearer 21 to the personal computer.

Figure 10D:
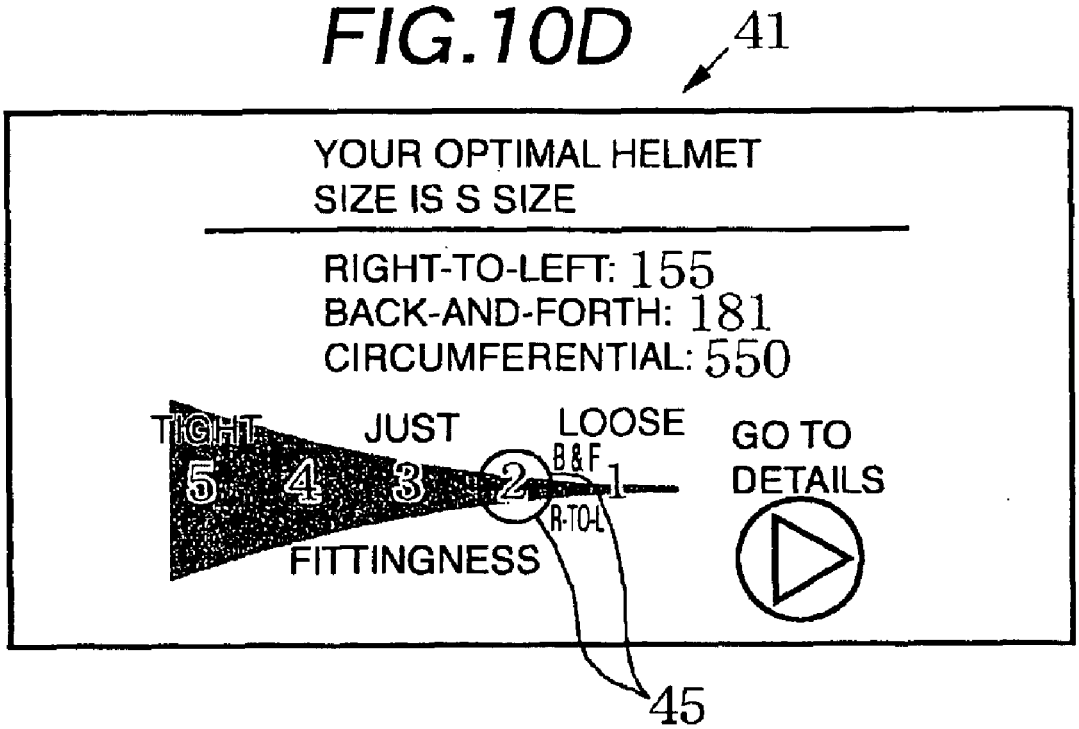
FIG. 10D is a view showing a personal computer window that displays a result of selection of the matching type of the helmet size.

When the back-and-forth length, right-to-left width and circumferential length of the head 22 of the helmet wearer 21 are input to the personal computer, the personal computer operator advances the personal computer window 41 to step 4 of FIG. 10D. In step 4 (that is, determination step), a determination result based on the three sizes is displayed on the personal computer window 41 through data processing (to be described below).

More specifically, the personal computer selects the matching type of the helmet size (to be referred as "first selection" in this specification) based on the back-and-forth length X and right-to-left width Y by using the above program. The first selection is performed in accordance with an adjusting data table 43 (see FIGS. 4 to 7C) for the first selection which is included in the program.

On the adjusting data table 43, as shown in FIGS. 4 to 7C, the values of the back-and-forth length X may be arranged according to the magnitude (that is, from a smaller value or from a larger value) as indices 53 of a vertical or horizontal array (corresponding to the graduations in the Y- or X-axis direction of the graph), and the values of the right-to-left width Y may be arranged according to the magnitude as indices 54 of a horizontal or vertical array. The values of the indices 53 and 54 are given in mm. On the adjusting data table 43, matching data in the back-and-forth direction of the helmet and matching data of the right-to-left direction of the helmet fill the cell of the intersection of a predetermined value of the back-and-forth length X and a predetermined value of the right-to-left width Y, as shown in FIGS. 5 to 7C.

Figure 8:
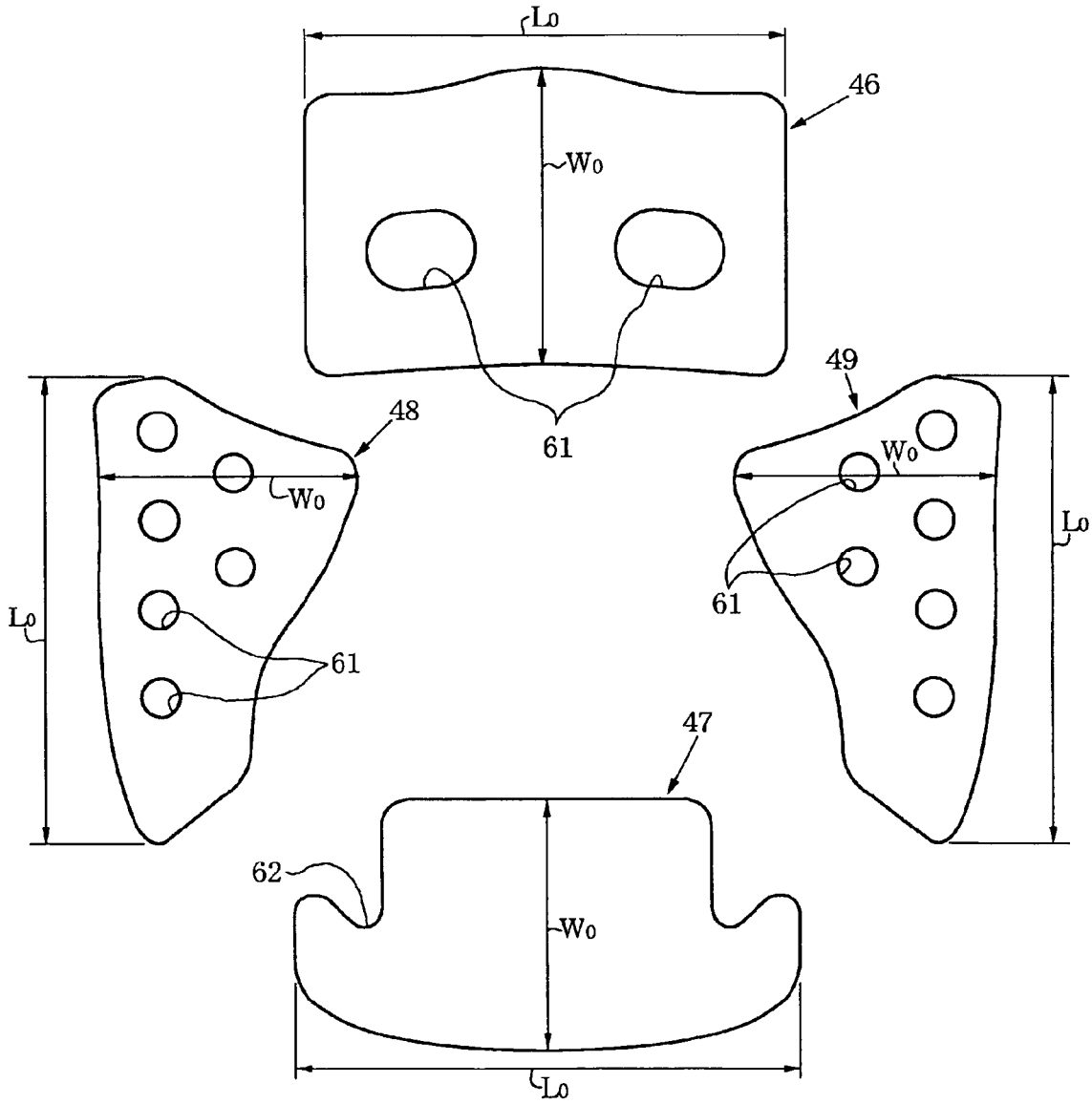
FIG. 8 is a plan view showing front, rear, left, and right side attaching pads used for adjusting the size of the helmet in the embodiment shown in FIGS. 1 to 7C as they are arranged to correspond to positions where they are to be attached to the helmet.

The matching data may include information regarding whether the size of the helmet 24 (see FIG. 10E), which is selected as the matching size by the first selection as will be described later, matches the head of the helmet wearer comparatively well, and if so, to what degree, and if not, what size adjusting operation should be performed to realize comparatively well matching. Information regarding what size adjusting operation should be performed to realize comparatively well matching may comprise attaching at least one of predetermined types of attaching pads 46 to 49 as shown in FIG. 8 to at least one of the front, back, left and right sides of the helmet 24 so that the head accommodating space of the helmet 24 may become small.

Figure 4:
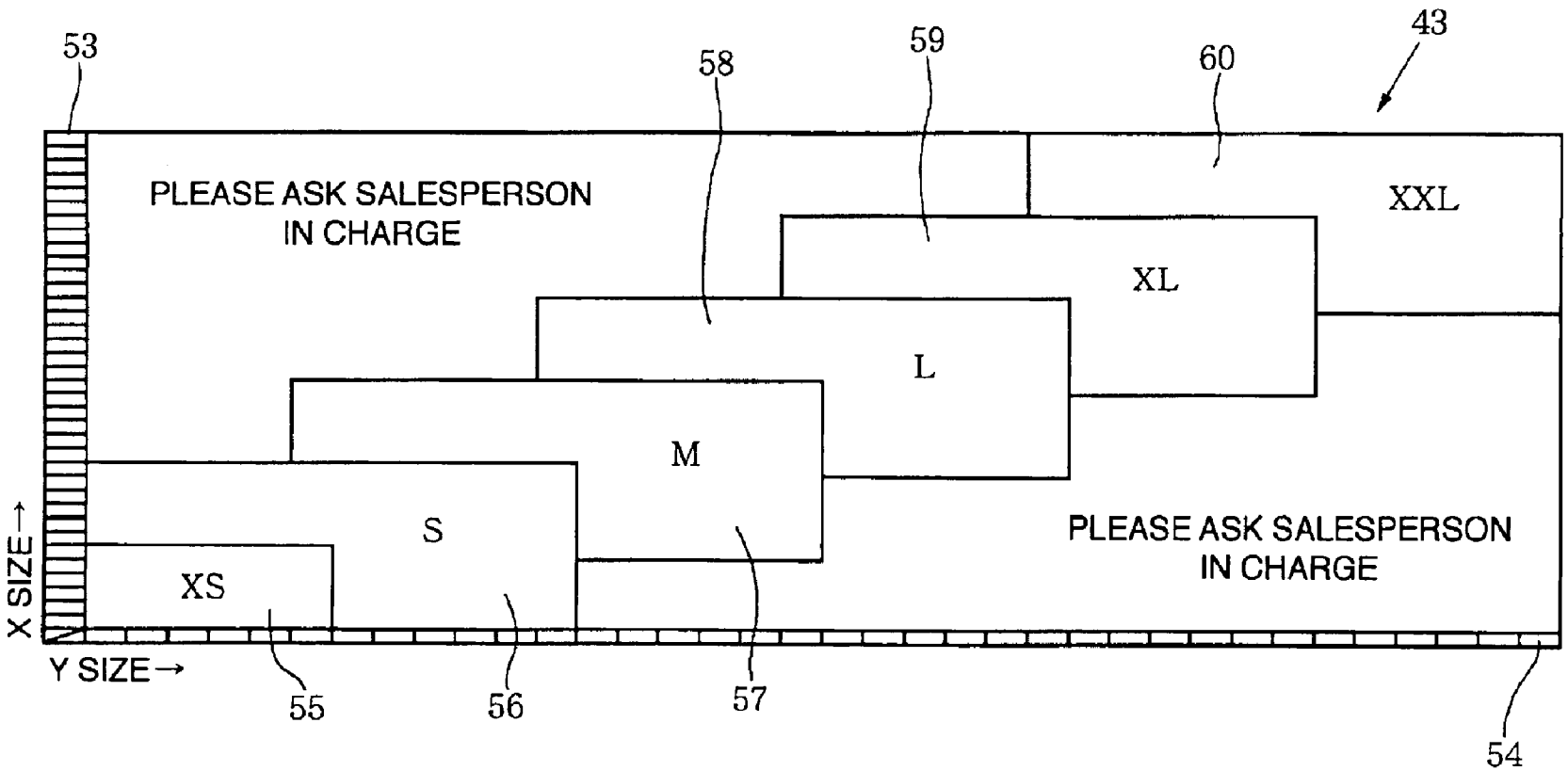
FIG. 4 is a schematic adjusting data table which explains a process of selecting the matching type of the helmet size based on the back-and-forth length X and right-to-left width Y actually measured in the processes of FIGS. 2A and 2B, respectively, and instructing whether or not size adjusting operation for the back-and-forth length and/or right-to-left width is necessary for the helmet of the selected-type size.
Figure 6:
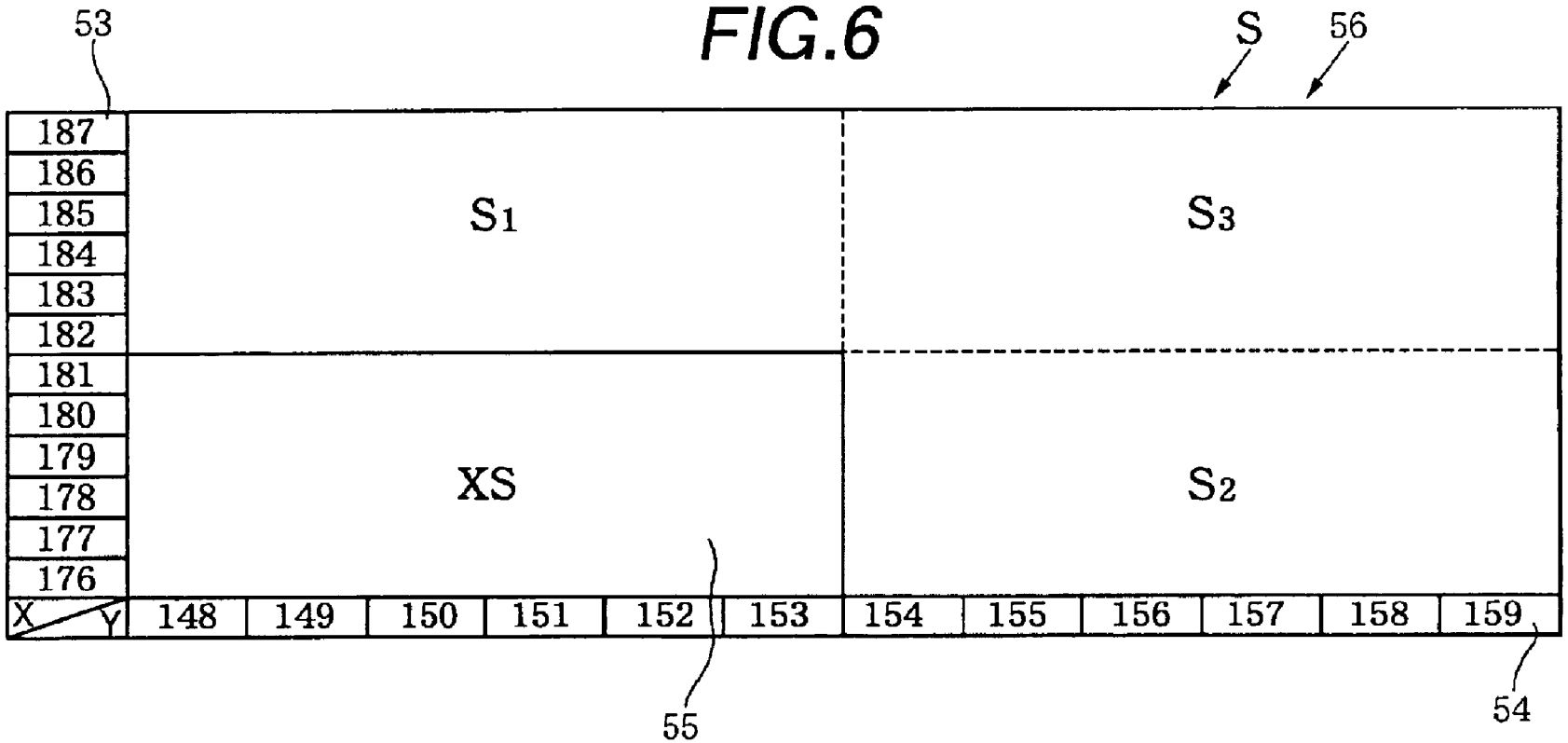
FIG. 6 is an enlarged table of the XS region and S region of the adjusting data table of FIG. 4.

As shown in FIG. 4, the adjusting data table 43 has regions corresponding to the types of the helmet sizes (i.e., an XS region 55, S region 56, M region 57, L region 58, XL region 59 and XXL region 60). Combinations of the back-and-forth lengths X and right-to-left widths Y which are comparatively close to an average human head shape are mostly included in the regions of the helmet size types. If given values of the two sizes (that is, X and Y) described above that are not included in the regions of the helmet size type are combined, neither the type of the helmet size nor its matching data is described, but a note "Please ask salesperson in charge" is made.

More specifically, the personal computer also selects the matching type of the size of the helmet based on the circumferential length L by using the above program (to be referred to as "second selection" in this specification). The second selection may be performed in accordance with a matching size table 42 (see FIG. 3) for the second selection which is included in the program. In FIG. 3 (and FIGS. 4 to 7C described above), matching sizes XS, S, M, L, XL and XXL indicate Extra Small, Small, Medium, Large, Extra Large and Double Extra Large, respectively. These sizes indicate the types of the helmet sizes in increasing order.

On the matching size table 42, as shown in FIG. 3, a row or column 51 of the "matching size" and a row or column 52 of the "circumferential length L" may be arranged in contrast with each other vertically or side by side. The row or column 51 of the "matching size" may have the types (i.e., XS, S, M, L, XL and XXL) of the helmet size that are arranged sequentially from a smaller size or from a larger size. Also, the row or column 52 of the "circumferential length L" may describe the ranges of the circumferential length L respectively corresponding to the types of the helmet sizes in contrast with them.

The helmet maker or helmet shop usually prepares at least six different sizes of helmets 24 for sale. Among the six different sizes of helmets 24, the head accommodating spaces may have substantially similar shapes, and only the sizes may be substantially different. The sizes of the outer shell, impact absorbing liner (neither one is shown), and the like of the helmets 24 may differ when necessary.

Therefore, if 550 mm (i.e., 55 cm) is input as the actual measurement value of the circumferential size L as described above, S size is selected as the matching size by the second selection in accordance with the matching size table 42 of FIG. 3, and is stored (see step 34 of FIG. 9).

If 181 mm and 155 mm are input as the actual measurement values of the back-and-forth length X and right-to-left width Y, respectively, as described above, S size corresponding to the S region that includes the intersection of the input values is selected as the matching size by the first selection in accordance of the adjusting data table 43 of FIGS. 4 to 7C, and is stored (see step 33 of FIG. 9). If the size type selected by the first selection (i.e., S size) coincides with the size type selected by the second selection (i.e., S size), the size selected by the first selection (in other words, second selection) is displayed on the personal computer window 41 of FIG. 10D as "Your optimal helmet size is S size".

If the size type selected by the first selection is larger than the size type selected by the second selection, size adjusting operation of attaching the attaching pads 46 to 49 (see FIG. 8) based on the adjusting data table 43 of FIGS. 4 to 7C is performed, as will be described later, so that adjustment of decreasing the size of the helmet 24 of the size type selected by the first selection can be performed. Hence, the final size of the helmet 24 can be set to a substantially optimal one for the helmet wearer 21 in accordance with the adjusting data table 43 of FIGS. 4 to 7C. In this case, the size type which is selected by the first selection is displayed as the optimal size of the helmet 24 on the personal computer window 41 of FIG. 10D in accordance with the above program, in the same manner as described above.

Conversely, if the size type selected by the first selection is smaller than the size type selected by the second selection, the size of the helmet 24 cannot be adjusted to a substantially optimal one based on the adjusting data table 43 of FIGS. 4 to 7C. Hence, in this case, it is determined that the type of the matching size cannot be selected in accordance with the above program, and the personal computer window 41 of FIG. 10D displays "Please ask salesperson in charge". Furthermore, when the actual values of the back-and-forth length X and right-to-left width Y are respectively input, if the intersection of the input values is not included in any one of the six types of size regions on the adjusting data table 43 of FIGS. 4 to 7C, it is difficult to set the helmet size to one which is substantially optimal for the helmet wearer 21 by performing the size adjusting operation of attaching the attaching pads 46 to 49 based on the adjusting data table 43, as will be described later. Therefore, in this case as well, it is determined that the type of the matching size cannot be determined in accordance with the above program, and the personal computer window 41 of FIG. 10D displays "Please ask salesperson in charge".

If 181 mm and 155 mm are input as the actual measurement values of the back-and-forth length X and right-to-left width Y, respectively, as described above, not only S size corresponding to the S region that includes the intersection of the input values is selected as the matching size in the first selection in accordance with the adjusting data table 43 of FIGS. 4 to 7C, but also the matching data on the cell of the intersection is also selected (see step 33 of FIG. 9). The matching data includes matching data in the back-and-forth direction of the head accommodating space of the helmet and matching data in the right-to-left direction of the head accommodating space. These two different matching data are described as just fit (match substantially optimally), tight fit (match rather tightly), loose fit (match rather loosely), operations A to E and operations J to N in FIGS. 4 to 7C.

In FIGS. 4 to 7C "X size", "Y size", "front and rear", "left and right", "operation", "just fit", "tight fit" and "loose fit" are sometimes or always abbreviated as "X", "Y", "F & R", "L & R", "OPN", "just", "tight" and "loose" in order to simplify the table. The operations A to E are used as the matching data in the back-and-forth direction. The operations J to N are used as the matching data in the right-to-left direction. Each of the operations A to E specifically indicates that predetermined numbers of predetermined attaching pads 46 and 47 (see FIG. 8) should be attached to the front and rear sides, respectively, of the head accommodating space of the helmet 24. Each of the operations J to N specifically indicates that predetermined numbers of predetermined attaching pads 48 and 49 (see FIG. 8) should be attached to the left and right sides, respectively, of the head accommodating space of the helmet. Each of the predetermined attaching pads 46 to 49 shown in FIG. 8 may comprise several types having different hardness values and/or sizes (thickness, length, width and the like), or may comprise one type having the same hardness and size.

If 181 mm and 155 mm are input as the actual measurement values of the back-and-forth length X and right-to-left width Y, respectively, as described above, it is obvious from FIGS. 7A to 7C (specifically FIG. 7B) that the matching data selected in accordance with the adjusting data table 43 of FIGS. 4 to 7C is "front and rear: operation B" and "left and right: operation M". In this case, "front and rear: operation B" specifically indicates "one pad with a hardness value a to each of the front and rear sides", and may signify that one attaching pad 46 and one attaching 47 (see FIG. 8) each with the hardness value a are to be attached to the front and rear sides, respectively. Also, "left and right: operation M" specifically indicates "one pad with a hardness value b to each of the left and right sides", and may signify that one attaching pad 48 and one attaching 49 (see FIG. 8) each with the hardness value b are to be attached to the left and right sides, respectively.

Hence, if 181 mm and 155 mm are input as the actual measurement values of the back-and-forth length X and right-to-left width Y, respectively, as described above, the personal computer window 41 in step 4 of FIG. 10D displays not only that the optimal size is S size, as described above, but also displays that the matching degree (i.e., fittingness) in each of the right-to-left direction and the back-and-forth direction is, e.g., of the second level among five levels (i.e., rather loose) by means of a substantially semicircular indicator 45 (see step 35 of FIG. 9). In FIG. 10D, each of the matching degree indicator 45 in the right-to-left direction and the matching degree indicator 45 in the back-and-forth direction is ranked the second level. Hence, a substantially circular indicator as a whole is attached to the second level. The substantially circular indicator is added with a horizontal line extending through its center.

Figure 10E:
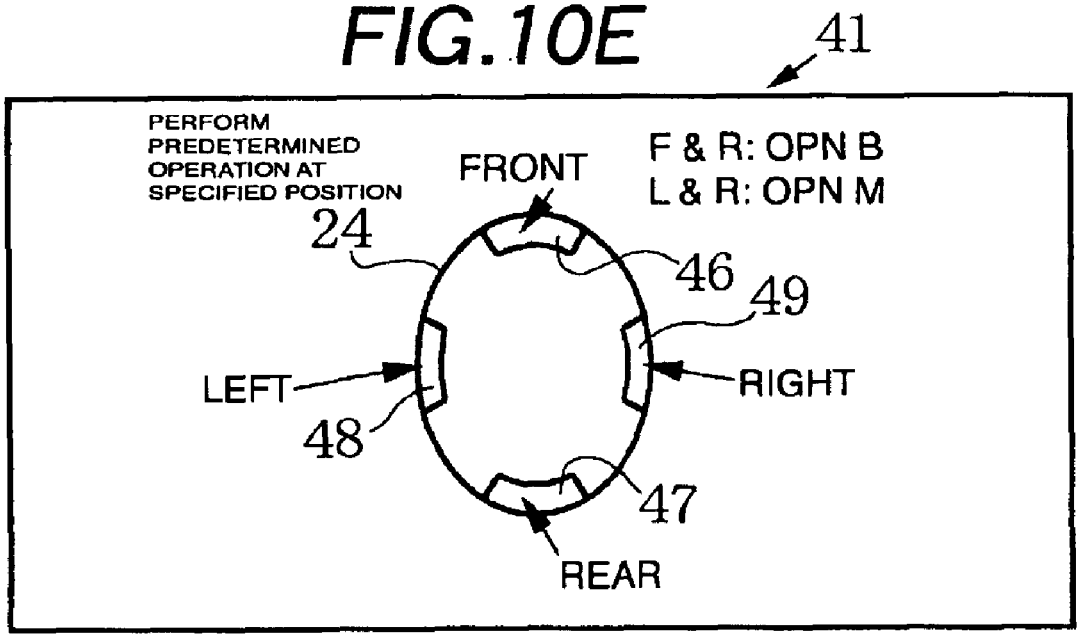
FIG. 10E is a view showing a personal computer window that displays whether or not size adjusting operation for the helmet of the selected-type size is necessary.

The personal computer operator then advances the personal computer window 41 to step 5 (i.e., detailed step) shown in FIG. 10E. In step 5, the matching data selected in accordance with the adjusting data table 43 of FIGS. 4 to 7C as described above (i.e., "front and rear: operation B" and "left and right: operation M") is displayed (see step 36 of FIG. 9). Step 36 can be ended at an arbitrary time point (see step 37 of FIG. 9).

(4) Adjusting Operation of Helmet Size

The size adjusting operator such as the employee of the helmet shop or helmet wearer can adjust the size of the helmet 24, which is selected as having the matching size, in the following manner in accordance with the matching data displayed in step 5 shown in FIG. 10E, as described in the above item (3) (see FIG. 10E). In this size adjusting operation, the front side attaching pad 46, rear side attaching pad 47, left side attaching pad 48 and right side attaching pad 49 shown in FIG. 8 are used. Some or all of the four different attaching pads 46 to 49 may have substantially the same shape. As the left side attaching pad 48 and right side attaching pad 49 are axi-symmetrical, one of the two pads 48 and 49 can be used as the other pad by reversing it.

The attaching pads 46 to 49 may be sheet pieces made of a foamed synthetic resin such as foamed urethane resin (so-called urethane sponge). In the embodiment shown in FIG. 8, of the attaching pads, for example, the front-side attaching pad 46 has a maximum length $L_0$ in the right-to-left direction, a maximum length $W_0$ in the direction of height (i.e., width) and a maximum thickness $T_0$ of about 15 cm, 10 cm and 3 mm, respectively. The maximum length $L_0$ in the right-to-left direction of each of the attaching pads 46 to 49 generally from the viewpoint of practicality, preferably falls within a range of 7.5 cm to 25 cm, and more preferably within a range of 10 cm to 20 cm. The maximum width $W_0$ of each of the attaching pads 46 to 49 generally from the viewpoint of practicality, preferably falls within a range of 5 cm to 18 cm, and more preferably within a range of 7.5 cm to 14 cm. The maximum thickness $T_0$ of each of the attaching pads 46 to 49 generally from the viewpoint of practicality, preferably falls within a range of 1 mm to 6 mm, and more preferably within a range of 2 mm to 4.5 mm. Each of the attaching pads 46 to 49 may have an opening 61 or a notch 62 as a ventilation hole or a ventilation notch (i.e., for ventilation) when necessary.

The adjusting operation of the helmet size is performed when necessary in accordance with the matching data displayed on the personal computer window 41 of step 5 shown in FIG. 10E. FIG. 10E schematically shows the attaching positions of the four different attaching pads 46 to 49 shown in FIG. 8. For example, in FIGS. 7A to 7C (specifically FIG. 7C), if the back-and-forth length X is 186 mm and the right-to-left width Y is 157 mm, the matching data is "front and rear: just fit" and "left and right: loose fit", and accordingly the adjusting operation of the helmet size is not necessary. If the matching data is "one pad with a hardness value a to each of the front and rear sides" and "one pad with a hardness value b to each of the left and right sides", as shown in FIG. 10E, one font side attaching pad 46 and one rear side attaching pad 47, each with a hardness value a, may be attached to the front and rear sides, respectively, of the helmet 24, and one left side attaching pad 48 and one right side attaching pad 49, each with a hardness value b, may be attached to the left and right sides, respectively, of the helmet 24.

When attaching the pads as described above, the attaching pads 46 and 47 shown in FIG. 8 may be attached to have a vertical relationship substantially the same as in the case of FIG. 8. The attaching pad 48 shown in FIG. 8 may be attached such that its left side substantially becomes the lower end, and the attaching pad 49 shown in FIG. 8 may be attached such that its right side substantially becomes the lower end. More specifically, each of the four different attaching pads 46 to 49 may be attached to the helmet 24 such that its central portion, its portion near the lower end or its middle portion between them in the vertical direction extends substantially along that portion of the head where the tape measure 23 shown in FIG. 2C is wound.

The attaching pads 46 to 49 can be attached to the helmet 24 in the following manner. More specifically, according to the first attaching method, pad storing pockets (not shown) are formed on the front, rear, left and right sides of the outer surface (i.e., a surface opposite to the head accommodating space) of an inside pad (not shown) in advance which is to be disposed on the inner surface side (i.e., a head accommodating space side) of an impact absorbing liner to be disposed on the inner surface side of the outer shell of the helmet 24. When the attaching pads 46 to 49 need to be attached to the helmet, they are stored in the pockets when necessary. According to the second attaching method, the attaching pads 46 to 49 are adhered to the inner surface of the impact absorbing liner of the helmet 24 or the outer surface of the inside pad of the helmet 24 with an adhesive. According to the third attaching method, first and second surface zippers such as Velcro closures (tradename) are attached to the outer surface of the inside pad of the helmet 24, and the inner surfaces of the attaching pads 46 to 49 in advance. When the attaching pads 46 to 49 need to be attached to the helmet, their second surface zippers are coupled to the first surface zipper of the inside pad. According to the fourth attaching method, first and second female-male fitting snap fasteners are attached to the outer surface of the inside pad disposed on the inner surface side of the impact absorbing liner which is disposed on the inner surface side of the outer shell of the helmet 24, and the inner surfaces of the attaching pads in advance. When the attaching pads need to be attached to the helmet, the second female-male fitting snap fasteners of the attaching pads are fitted with the first female-male fitting snap fasteners of the inside pad by female-male fitting. According to the fifth attaching method, the attaching pads 46 to 49 are attached to the helmet by only interposing them between the impact absorbing liner of the helmet 24 and the inside pad of the helmet 24. Also, the attaching pads 46 to 49 can be attached to the helmet 24 by employing a plurality of the first to fifth methods described above.

When adjusting operation of the helmet size is performed, as described above, even if the head shape of the helmet wearer is different from an average human head shape, a helmet that matches the head of the helmet wearer substantially optimally can be obtained comparatively easily.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, display of an optimal helmet size together with its fittingness (determination step), and display of its matching data (detailed step) are performed on different personal computer windows 41. Alternatively, display in the determination step and display in the detailed step may be combined and performed on one personal computer window 41. In this case, the fittingness may be omitted, or may be displayed on a different personal computer window 41. An optimal helmet size together with its fittingness, and its matching data need not be displayed on the personal computer window 41 but can be printed on a paper sheet or the like, or can be displayed on the personal computer window 41 and at the same time printed on a paper sheet or the like.

In the above embodiment, if the size type selected by the first selection is smaller than the size type selected by the second selection, none of an optimal helmet size, its fittingness and its matching data is selected or displayed. Even in this case, if an adjusting data table different from that of FIGS. 4 to 7C is included in the program, the size selected by the second selection can be displayed as an optimal helmet size, and its fittingness and matching data based on the different adjusting data table can be displayed.

In the above embodiment, the employee of the helmet shop, the helmet wearer, or the like adjusts the helmet size. Alternatively, the helmet wearer may order a helmet directly from a helmet maker or the like via a computer network by attaching first information on the back-and-forth length, right-to-left width and circumferential length of his head, or second information on an optimal size and its fittingness shown in the determination step of FIG. 10D and on matching data shown in the detailed step of FIG. 10E. In this case, the helmet maker or the like may perform attaching operation (i.e., size adjusting operation) of the attaching pads 46 to 49 for the helmet of the optimal size, when necessary, and may deliver to the helmet wearer the helmet which is size-adjusted when necessary. The first and/or second information as described above may be stored as customer data on a database at the helmet maker or helmet shop.

Although the present invention is applied to a full-face-type helmet in the above embodiment, it can also be applied to a different type of helmet, e.g., a jet- or semi-jet type helmet.

What is claimed is:

1. A method of selecting a matching type of a size of a helmet, comprising the steps of:

inputting a back-and-forth length and right-to-left width of a head of a helmet wearer as data to a computer that can use a program necessary for selection of the type;

processing the data of the back-and-forth length and right-to-left width by using the program, thus selecting the type of a helmet size, that matches the helmet wearer, and matching data of the type; and displaying the type of the matching helmet size and the matching data of the type.

2. A method according to claim 1, wherein the matching data includes information on whether or not size adjusting operation is necessary for the helmet of the type of the matching helmet size.

3. A method according to claim 1, further comprising the steps of:

inputting a circumferential length of the head of the helmet wearer as data to the computer; and processing the data of the circumferential length by using the program, thus selecting the type of a helmet size that matches the helmet wearer, wherein if the type of the helmet size selected based on the back-and-forth length and right-to-left width is smaller than the type of the helmet size selected based on the circumferential length, the type of the matching helmet size and matching data thereof are not displayed.

4. A method according to claim 1, further comprising the step of displaying a fittingness of the type of the matching helmet size.

5. A method according to claim 1, wherein a type of the helmet size corresponding to a size region that includes an intersection of the back-and-forth length and right-to-left width on an adjusting data table included in the program, and matching data corresponding to a cell of the intersection on the adjusting data table are selected.

6. A method according to claim 1, wherein the matching data includes matching data in a back-and-forth direction of a head accommodating space of the helmet, and matching data in a right-to-left direction of the head accommodating space.

7. A method according to claim 3, wherein a type of the helmet size corresponding to the circumferential length on a matching size table included in the program is selected as the type of the helmet size that is selected based on the circumferential length.

8. A method according to claim 1, further comprising the step of actually measuring the back-and-forth length and right-to-left width of the head of the helmet wearer with a head size measuring tool, wherein the head size measuring tool comprises a pair of measuring tool pieces which are movable relative to each other and have substantial inverted-L shapes to form a substantial inverted-U shape as a whole, and a scale which indicates moved distances of the pair of measuring tool pieces relative to each other.

9. A method according to claim 3, further comprising the step of actually measuring the circumferential length of the head of the helmet wearer with a tape measure.

10. A method according to any one of claims 1 to 9, wherein the helmet is a full-face-type helmet.

11. A helmet size adjusting method with which a matching type of a size of a helmet is selected and the size of the helmet is adjusted by using the selecting result, comprising the steps of:

inputting a back-and-forth length and right-to-left width of a head of a helmet wearer as data to a computer that can use a program necessary for selection of the type;

processing the data of the back-and-forth length and right-to-left width by using the program, thus selecting the type of a helmet size, that matches the helmet wearer, and matching data of the type including information on whether or not size adjusting operation is necessary for the helmet of the type of the matching helmet size; and displaying the type of the matching helmet size and the matching data of the type;

wherein size adjusting operation of adjusting a size of a helmet which is of a type of the matching helmet size is performed based on an instruction on a necessity of the size adjusting operation included in the matching data.

12. A method according to claim 11, further comprising the steps of:

inputting a circumferential length of the head of the helmet wearer as data to the computer; and processing the data of the circumferential length by using the program, thus selecting the type of a helmet size that matches the helmet wearer, wherein if the type of the helmet size selected based on the back-and-forth length and right-to-left width is smaller than the type of the helmet size selected based on the circumferential length, the type of the matching helmet size and matching data thereof are not displayed.

13. A method according to claim 11, further comprising the step of displaying a fittingness of the type of the matching helmet size.

14. A method according to claim 11, wherein a type of the helmet size corresponding to a size region that includes an intersection of the back-and-forth length and right-to-left width on an adjusting data table included in the program, and matching data corresponding to a cell of the intersection on the adjusting data table are selected.

15. A method according to claim 11, wherein the matching data includes matching data in a back-and-forth direction of a head accommodating space of the helmet, and matching data in a right-to-left direction of the head accommodating space.

16. A method according to claim 12, wherein a type of the helmet size corresponding to the circumferential length on a matching size table included in the program is selected as the type of the helmet size that is selected based on the circumferential length.

17. A method according to claim 11, further comprising the step of actually measuring the back-and-forth length and right-to-left width of the head of the helmet wearer with a head size measuring tool, wherein the head size measuring tool comprises a pair of measuring tool pieces which are movable relative to each other and have substantial inverted-L shapes to form a substantial inverted-U shape as a whole, and a scale which indicates moved distances of the pair of measuring tool pieces relative to each other.

18. A method according to claim 12, further comprising the step of actually measuring the circumferential length of the head of the helmet wearer with a tape measure.

19. A method according to claim 11, wherein the size adjusting operation comprises attaching at least one attaching pad to at least one portion of front, rear, left and right sides of the helmet such that the head accommodating space of the helmet decreases.

20. A method according to claim 19, wherein the attaching pad has a maximum length in a right-to-left direction falling within a range of 7.5 cm to 25 cm, a maximum length in a direction of height falling within a range of 5 cm to 18 cm and a maximum thickness falling within a range of 1 mm to 6 mm.

21. A method according to claim 19, wherein the attaching pad has a maximum length in a right-to-left direction falling within a range of 10 cm to 20 cm, a maximum length in a direction of height falling within a range of 7.5 cm to 14 cm and a maximum thickness falling within a range of 2 mm to 4.5 mm.

22. A method according to claim 19, wherein the attaching pad has at least one of a ventilation opening and ventilation notch.

23. A method according to claim 19, wherein the attaching pad is attached by forming pad storing pockets on front, rear, left and right sides of an outer surface of an inside pad which is to be disposed on an inner surface side of an impact absorbing liner to be disposed on an inner surface side of an outer shell in advance, and when the attaching pad need to be attached to the helmet, the attaching pad is stored in a necessary one of the pockets.

24. A method according to claim 19, wherein the attaching pad is attached by adhesion with an adhesive to at least either one of an inner surface of an impact absorbing liner to be disposed on an inner surface side of an outer shell and an outer surface of an inside pad to be disposed on an inner surface side of the impact absorbing liner.

25. A method according to claim 19, wherein the attaching pad is attached by attaching first and second surface zippers to an outer surface of an inside pad to be disposed on an inner surface side of an impact absorbing liner which is to be disposed on an inner surface side of an outer shell, and an inner surface of the attaching pad in advance, and when the attaching pad need to be attached to the helmet, the second surface zipper of the attaching pad is coupled to the first surface zipper of the inside pad.

26. A method according to claim 19, wherein the attaching pad is attached by attaching first and second female-male fitting snap fasteners to an outer surface of an inside pad disposed on an inner surface side of an impact absorbing liner which is disposed on an inner surface side of an outer shell, and an inner surface of the attaching pad, and when the attaching pad need to be attached to the helmet, the second female-male fitting snap fastener of the attaching pad is fitted and coupled with the first female-male fitting snap fastener of the inside pad by female-male fitting.

27. A method according to claim 19, wherein the attaching pad is attached by interposing the attaching pad between an impact absorbing liner to be disposed on an inner surface side of an outer shell, and an inside pad to be disposed on an inner surface side of the impact absorbing pad.

28. A method according to any one of claims 11 to 27, wherein the helmet is a full-face-type helmet.

* * * * *